US005824972A

United States Patent [19]

Butler

[11] Patent Number: 5,824,972

[45] Date of Patent: Oct. 20, 1998

[54] ACOUSTIC MUFFLER

[76] Inventor: Boyd L. Butler, 1672 E. 10770 S., Sandy, Utah 84092

[21] Appl. No.: 855,826

[22] Filed: May 13, 1997

[51] Int. Cl.[6] ..... F01N 1/12

[52] U.S. Cl. ..... 181/279; 181/280; 181/265

[58] Field of Search ..... 181/251, 255, 181/257, 264, 265, 268, 269, 270, 272, 275, 279, 280, 281, 282

[56] References Cited

U.S. PATENT DOCUMENTS

| | | | |
|---|---|---|---|
| 981,584 | 1/1911 | Miller | 181/265 |
| 1,002,801 | 9/1911 | Boeck | 181/264 |
| 4,125,171 | 11/1978 | Morris | 181/265 |
| 5,152,366 | 10/1992 | Reitz | 181/264 X |
| 5,304,749 | 4/1994 | Crandell | 181/264 |

FOREIGN PATENT DOCUMENTS

| | | | |
|---|---|---|---|
| 667215 | 1/1929 | France | 181/264 |

*Primary Examiner*—Khanh Dang
*Attorney, Agent, or Firm*—Mallinckrodt & Mallinckrodt

[57] ABSTRACT

A muffler for reducing acoustic noise contained in a gas flow, such as created by internal combustion engines, air compressors, and blower manifolds. The muffler consists of a conventional sheet metal casing which has an inlet and an outlet at opposite ends thereof. A flow of gas containing acoustic noise flows from inlet to outlet. A plurality of spiral acoustic traps, each of which extend from bottom to top of the casing, have a central axis positioned perpendicular to the gas flow. An opening in each spiral acoustic trap extends into the gas flow to divert some gas into the trap, wherein the gas flows in a circular path so as to degrade and randomize the sound waves into heat, by utilizing a circular mixing process with increased gas retention time. Gas is drawn out of the acoustic trap through a series of vent holes in the acoustic trap on the back side of the acoustic trap opposite the opening, by utilizing a venturi effect created by part of the inlet gas flow which is split off into a peripheral gas flow to flow around the acoustic trap through a constricted area just ahead of the vent holes, created by the acoustic trap and the adjacent casing wall or adjacent trap, so as to create a low pressure zone at the vent holes to continuously draw gas out of the acoustic trap. The acoustic traps may be oriented in a single or multiple linearly extending staggered groups, with in-line or offset inlets and outlets.

32 Claims, 9 Drawing Sheets

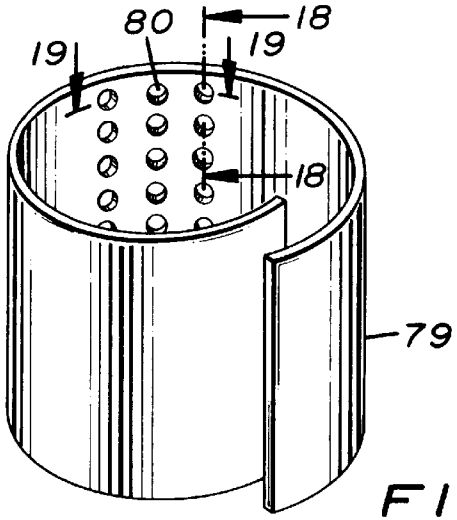
FIG. 17
FIG. 18
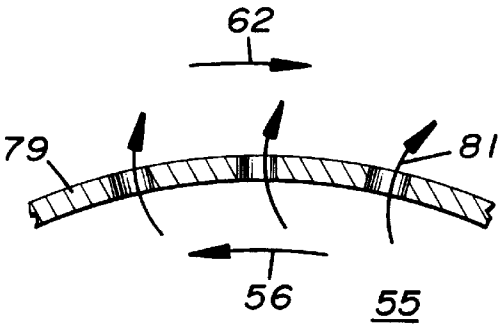
FIG. 19
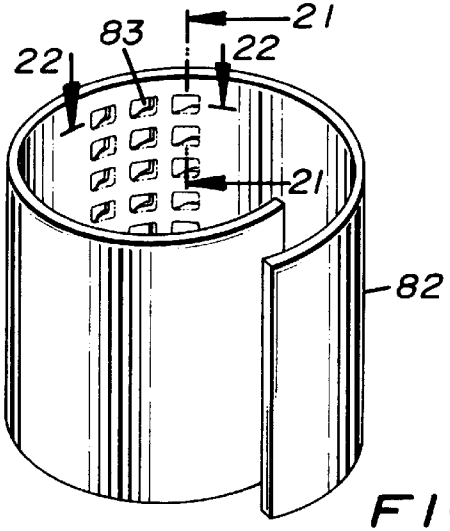
FIG. 20
FIG. 21
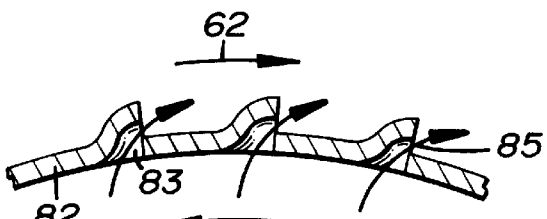
FIG. 22

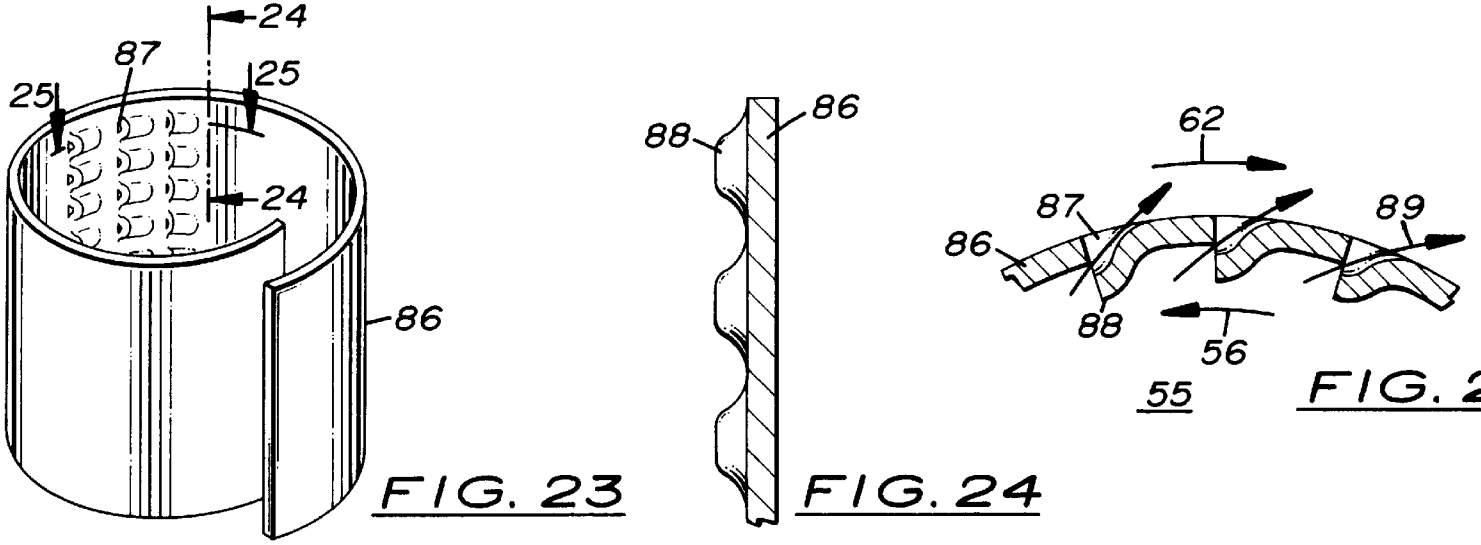
FIG. 23
FIG. 24
FIG. 25
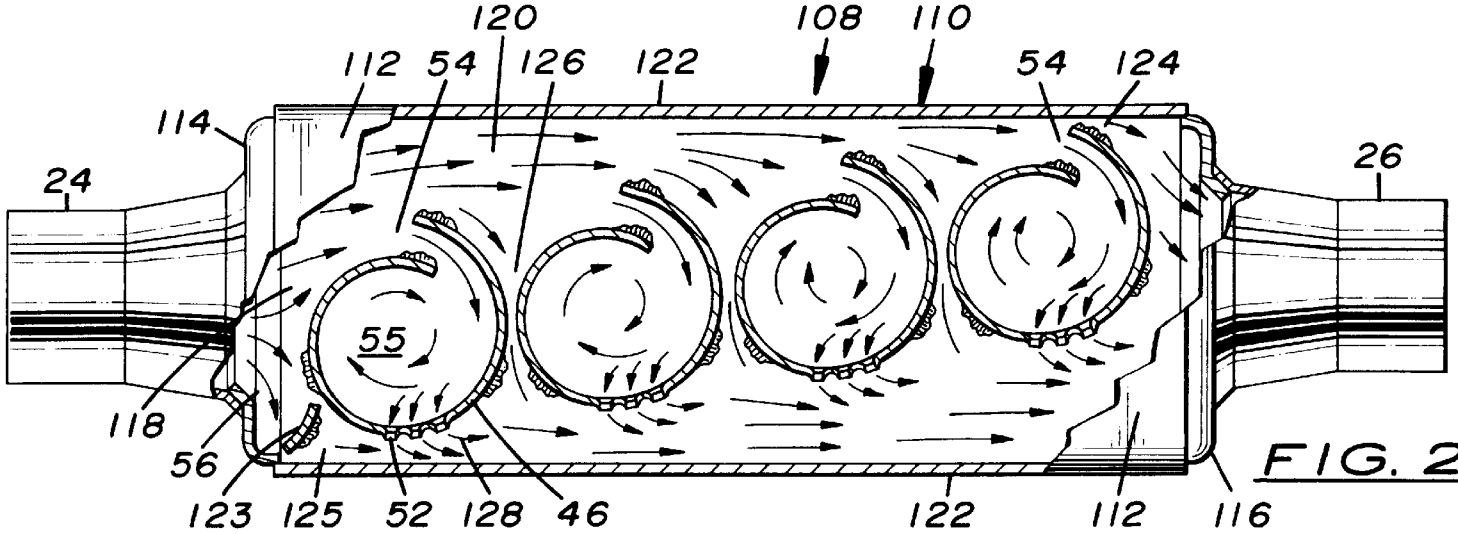
FIG. 27

ACOUSTIC MUFFLER

BACKGROUND OF THE INVENTION

1. Field

The present invention is directed to a muffler for reducing acoustic noise in a gas flow such as that created by internal combustion engines, air compressors, blower manifolds, and various industrial applications.

2. State of the Art

Prior art acoustic mufflers are of two types, friction type mufflers which mix the gas flow to break up the sound waves, and absorption mufflers which absorb the sound waves in an acoustic damping material.

The friction type muffler is used most frequently, particularly on automobiles. This type of muffler has a casing with an inlet and outlet which can be positioned in a variety of locations, and a series of baffle plates therebetween to direct the gas flow in a circuitous route from inlet to outlet to cause mixing of the gas flow. Offset perforated inlet and outlet pipes may each extend the length of the casing to provide the circuitous route.

Friction type mufflers are generally quite effective at reducing noise levels, but because of the circuitous route followed by the exhaust gases passing through the muffler, offer substantial resistance to gas flow. Therefore, significant pressure is required to force the gases through the muffler. This pressure, referred to as back pressure, reduces the efficiency and power output of the engine being muffled.

The absorption type muffler has a casing with a pipe extending completely therethrough. A portion of the pipe inside the casing is perforated and the space between the pipe and casing is filled with sound absorbing fiberglass, ceramic fibers, or metallic wool mesh to absorb sound waves. By allowing the exhaust gases to pass directly through the muffler, the pressure required to push the gas through the muffler is significantly reduced. Therefore, the back pressure is much less than with friction type mufflers and more power is obtained from the engine. However, the sound attenuation is much less than with friction mufflers, and such mufflers are unacceptable in most uses.

Muffler acoustic efficiency is measured in decibels of noise attenuation (dba) versus gas flow in cubic feet per minute (CFM). When a pressure difference of 5 inches of water is imposed between the inlet and outlet, and using a common 2½ inch diameter muffler inlet and outlet, friction type mufflers have about 13–20 dba attenuation and 70–100 CFM flow. Absorption type straight through mufflers under those conditions have an attenuation of about 2–7 dba and 200 CFM flow.

There is a need in many applications for a muffler which has greater acoustic attenuation than the absorption type muffler with higher flow rates and less back pressure than the friction type mufflers.

SUMMARY OF THE INVENTION

A compact acoustic muffler utilizes a circular mixing process with increased gas retention time to attenuate acoustic noise more effectively than an absorption muffler and with substantially less back pressure than friction mufflers. It has been found that spiral shaped acoustic traps which provide circular mixing of a main gas flow combined with a venturi effect created around the traps by a peripheral gas flow which draws the gas from the acoustic traps through outlet vents in the acoustic traps provides effective acoustic muffling while achieving high flow rates with minimal back pressure.

One or more spiral acoustic traps are strategically placed inside a standard rectangular type muffler casing. Each spiral acoustic trap comprises a single, preferably thin wall, which is loosely wrapped about a central axis and which wall spans between opposing casing top and bottom walls. The spaced ends of the acoustic trap define an entrance opening through which gas can enter into an inner chamber formed by the acoustic trap wall, and opposing top and bottom casing walls. A series of vent holes extend through the acoustic trap wall in an appropriate location away from the opening to allow gas flow from the inner chamber.

When inlet gas flows through the casing inlet it is split into one or more main gas flows and one or more smaller peripheral gas flows, each of which flow in the general direction of an outlet in the casing. The main gas flow moves on the open side of each acoustic trap, i.e., the side with entrance opening, with the central axis of each trap extending substantially perpendicular to the main gas flow, and the entrance opening of each trap located in the main gas flow so as to divert a portion of the main gas flow into the inner chamber. The diverted gas forms an inner chamber gas flow which travels in a continuous circular mixing motion so as to break up the sound waves into random molecular motion, adding heat energy to the gas.

The peripheral gas flow travels on the opposite side, or back side of the spiral acoustic traps from the entrance opening. The volume and rate of peripheral gas flow may be set by a perforated metering screen, a metering plate, or other appropriate restriction, which partially or completely covers the opening between the backside of the first trap of each group, the side wall, and opposing casing top and bottom walls. The back side of each trap, along with the casing side wall or other acoustic traps, form a venturi through which the peripheral gas flow is accelerated to form a low pressure zone. A series of vents or outlets through each acoustic trap wall may be present between the inner chamber gas flow and the low pressure zone to draw gas from the inner chamber, in the form of a vent gas flow, into the peripheral gas flow to make room for more of the main gas flow to enter the inner chamber to join the inner chamber gas flow. While providing a vent or outlet through the trap wall enhances air flow through the trap to better absorb more of the acoustic energy such vents or outlets may not be absolutely required. Also, one or more vents or outlets may be present in the casing leading from the traps to the outside of the casing. In this configuration, a low pressure area or venturi effect may be present to assist in pulling gases from the traps.

The acoustic traps are generally placed in one or two linearly extending groups of acoustic traps so as to maximize the uptake of the main gas flow, with the openings of successive acoustic traps extending further into the main gas flow. When two groups of linearly extending traps are used, one group has the spiral in one direction (e.g. clockwise) and the other group has each acoustic trap flipped end for end so as to have the spiral in the opposite direction (e.g. counterclockwise). Each of the two groups of acoustic traps are positioned so as to extend into the main gas flow, in a staggered relationship with the opposing group, such that opposing traps are offset by about half a trap width, and with each successive trap overlapping the main gas flow further.

In some versions of the muffler an inlet and outlet pipe are used, wherein the pipes are aligned with the longitudinal center-line of the casing, in some versions an inlet and outlet pipe are offset adjacent opposing side walls, and in some versions both pipes are in line adjacent the same wall. In the latter two cases, an arcuate deflector plate is used to direct the majority of the inlet gas flow toward the center of the casing, while allowing some gas flow to circumvent the deflector on both sides thereof.

THE DRAWINGS

The best mode presently contemplated for carrying out the invention is illustrated in the accompanying drawings, in which:

FIG. 17 is a perspective view of a fourth embodiment of an acoustic trap of the invention.

FIG. 18 is a fragmentary longitudinal section taken along the line 18—18 of FIG. 17.

FIG. 19 is a fragmentary transverse section taken along the line 19—19 of FIG. 17.

FIG. 20 is a perspective view of a fifth embodiment of an acoustic trap of the invention.

FIG. 21 is a fragmentary longitudinal section taken along the line 21—21 of FIG. 20.

FIG. 22 is a fragmentary transverse section taken along the line 22—22 of FIG. 20.

FIG. 23 is a perspective view of a sixth embodiment of an acoustic trap of the invention.

FIG. 24 is a fragmentary longitudinal section taken along the line 24—24 of FIG. 23.

FIG. 25 is a fragmentary transverse section taken along the line 25—25 of FIG. 23.

FIG. 27 is a top plan view of a third embodiment of the invention with a portion of the top of the case broken away to show the interior arrangement of the acoustic traps and showing the air flow therein.

DETAILED DESCRIPTION OF THE ILLUSTRATED EMBODIMENTS

The invention provides an acoustic muffler having a superior acoustic attenuation and gas flow rate compared to back pressure. This is accomplished by utilizing spiral shaped acoustic traps to perform a circular mixing process to portions of the inlet gas entering the muffler, the main gas flow, and by utilizing a venturi effect created by another portion of the inlet gas flow, the peripheral gas flow, to help remove the mixed main flow gas, in the form of an inner chamber gas flow, from the acoustic traps. The acoustic muffler of the invention is of simple, light weight, yet durable design and construction, which may be economically fabricated entirely from sheet metal components, or from other materials.

Figure 4:
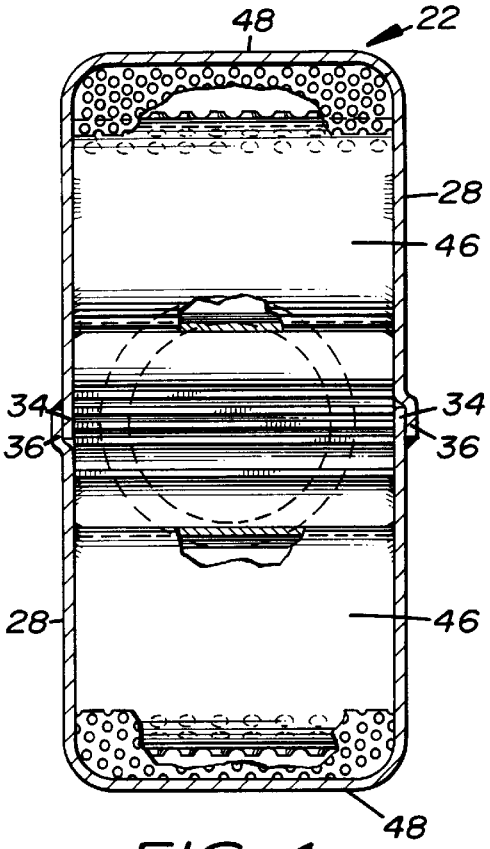
FIG. 4 is a transverse section taken along the line 4—4 of FIG. 2.
Figure 5:
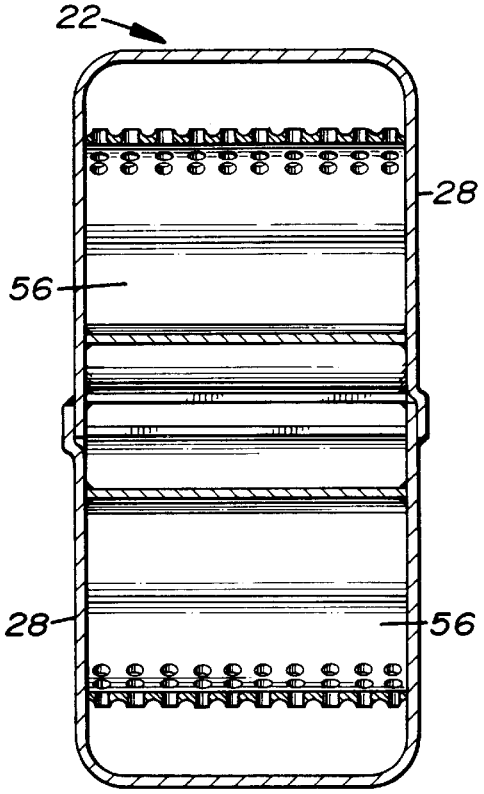
FIG. 5 is a transverse section taken along the line 5—5 of FIG. 2.
Figure 1:
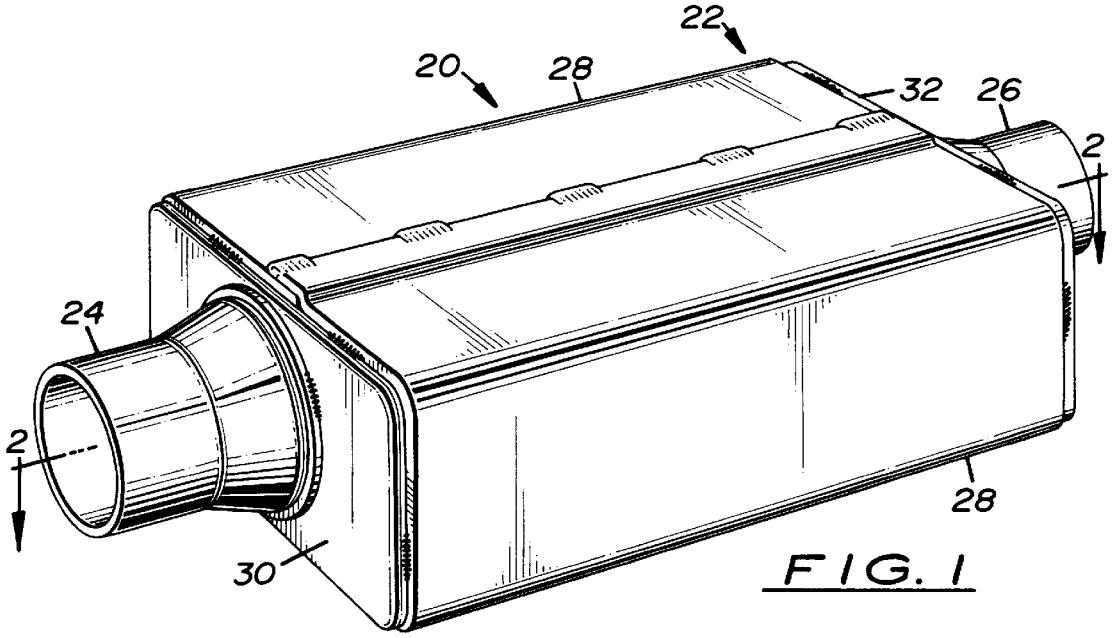
FIG. 1 is a perspective view of a first embodiment of the invention.

FIG. 1 shows the external construction of the preferred embodiment of the muffler. The external portion of muffler 20 consists of a casing 22, a flared inlet tube 24, and a flared outlet tube 26, which are welded together so as to form a unitary structure. Casing 22 itself consists of two U-shaped casing halves 28, an inlet cover 30, and an outlet cover 32. It should be noted that for all embodiments of the invention, the flared inlet and outlet tubes may be identical parts, and the inlet and outlet covers may be the identical parts, depending on the particular muffler application. The casing halves 28 each have a straight lip 34 and a raised lip 36 which mate together, with straight lip 34 fitting under raised lip 36 and which are welded together to form a strong, leak resistant joint (FIG. 4). The gas flow enters casing 22 through inlet tube 24 and flows generally in the direction of outlet tube 26. While inlet tube 24 and outlet tube 26 are typically used, they are not required of the invention, as other adapting means may be used to secure the casing to, for example, an automobile exhaust pipe.

Figure 2:
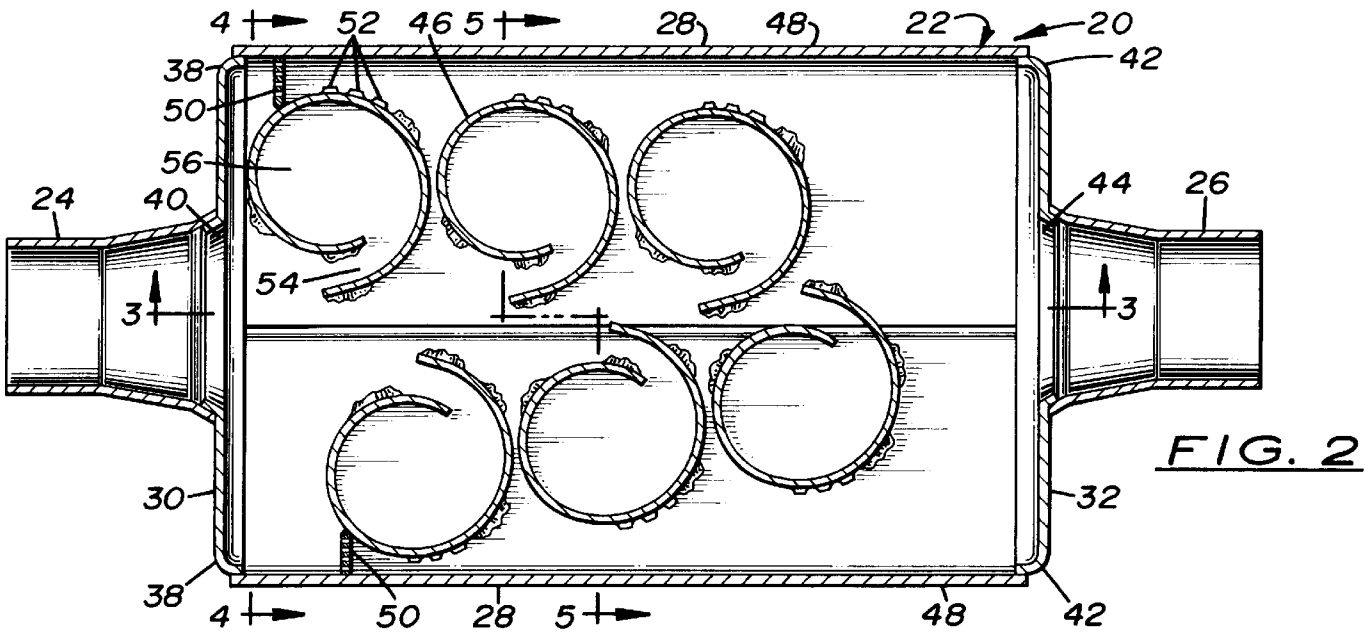
FIG. 2 is a longitudinal section taken along the line 2—2 of FIG. 1.
Figure 3:
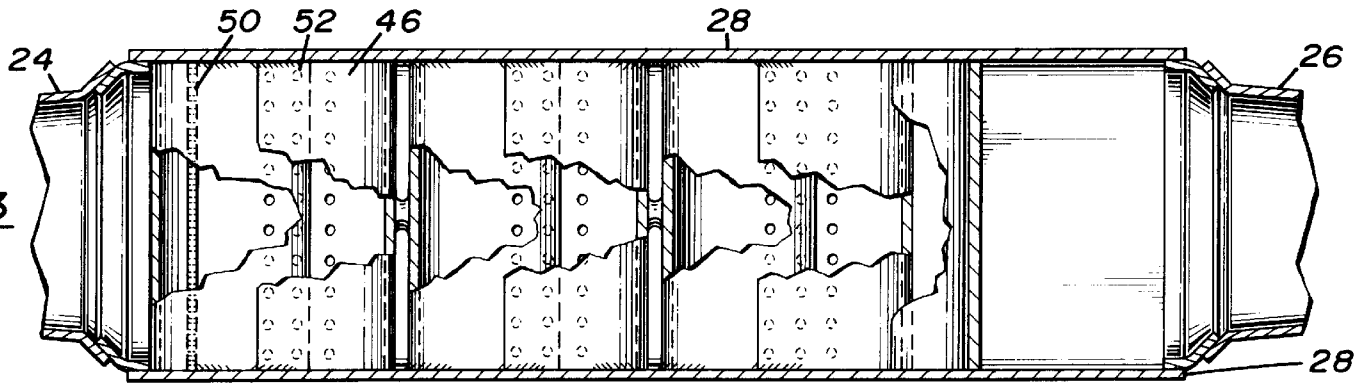
FIG. 3 is a longitudinal section taken along the line 3—3 of FIG. 2.

Referring to FIG. 2, inlet cover 30 is preferably a stamped metal part, with rolled edges 38 which fit into casing halves 28, and an outwardly flared inlet aperture 40 which mates with flared inlet tube 24. Likewise, outlet cover 32, which is similar to inlet cover 30, is preferably a stamped metal part with rolled edges 42 which fit into casing halves 28, and an outwardly flared outlet aperture 44 which mates with flared outlet tube 26. In this preferred embodiment, two groups of spiral acoustic traps 46 are disposed within casing 22, with one group flipped end for end, so as to effectively form an oppositely wound spiral, which is an identical part. Successive acoustic traps 46 from each group are staggered, by about half an acoustic trap width, and converge toward the opposing group toward the outlet 26. The acoustic traps 46 may overlap as shown. A metering screen 50 spans between the back side of the first acoustic trap 46 of each group, the adjacent casing half side wall 48, and opposing casing top and bottom walls.

Figure 8:
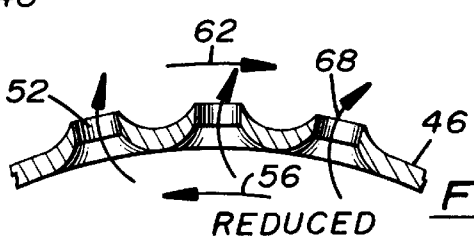
FIG. 8 is a fragmentary transverse section taken along the line 8—8 of FIG. 6.
Figure 7:
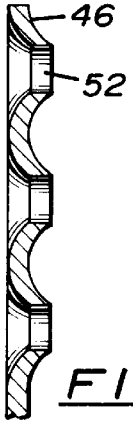
FIG. 7 is a fragmentary longitudinal section taken along the line 7—7 of FIG. 6.
Figure 6:
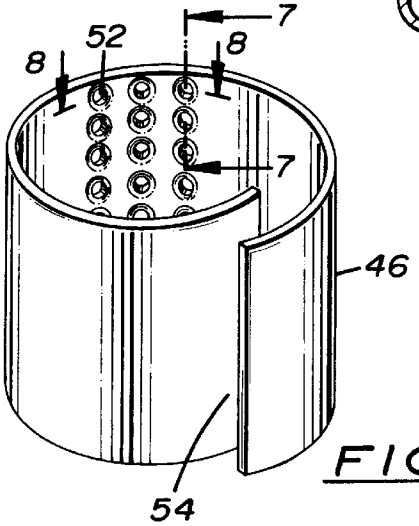
FIG. 6 is a perspective view of an embodiment of an acoustic trap of the invention.

As best seen in FIGS. 6, 7, and 8, each spiral acoustic trap 46 is made from a single rectangular or square piece of sheet metal, preferably fourteen gauge to twenty gauge in which a series of vents or outlets 52 are punched. The vents 52, as shown, are dimpled or frustoconical in shape, such that gas is funneled into the vent such that it can pass more easily in the direction the dimples or cones point. There may be one, two, three, or more columns of vents 52, with alternate columns having vents aligned or staggered, with a variety of other arrangements possible. While vents 52 are shown in three rows which extend the entire height of the acoustic traps 46, and are of an outwardly extending dimpled shape in this particular embodiment, other configurations and other suitable arrangements of vents are also possible.

The spiral shape of acoustic trap 46 is created when the sheet of metal is bent, slightly more than one turn, into a spiral shape around a central axis to form a spiral wall. Acoustic traps 46 span between top and bottom walls of casing 22, with the central axis of each acoustic trap 46 substantially perpendicular to the relative gas flow. A trap entrance opening 54 is formed by the ends of the spiral acoustic trap 46 being offset, with the entrance opening 54 leading to an inner chamber 55 formed by acoustic trap 46 and the opposing top and bottom casing walls of casing 22, and with the entrance opening 54 extending into the main gas flow so as to divert a portion of the gas flow and accompanying sound waves into inner chamber 55. The openings 54 of successive acoustic traps 46 are offset in the relative gas flow so as to assure that all acoustic traps 46 receive an adequate flow of gas. The openings 54 may completely overlap the gas flow path so as to effectively divert the majority of the gas flow into the acoustic traps 46.

Figure 9:
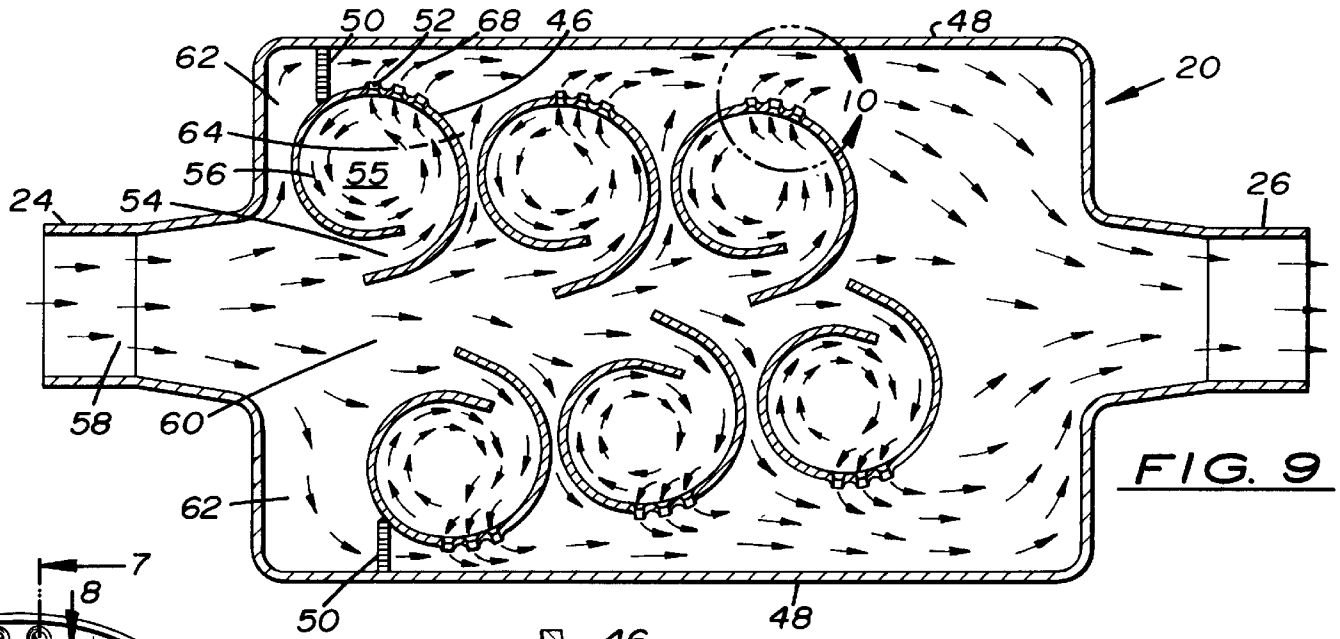
FIG. 9 is an air flow schematic of the first embodiment of the invention.

The flow of gas through muffler 20, from inlet tube 24 to outlet tube 26 is shown in FIG. 9. An inlet gas flow 58 enters muffler 20 through inlet tube 24 and is split into a main gas flow 60 and two peripheral gas flows 62.

The main gas flow 60, is that portion of the inlet gas flow 58 which flows on the side of acoustic traps 46 on which opening 54 is located. The majority of main gas flow 60 is incrementally diverted through acoustic trap openings 54, with a small portion thereof flowing between the acoustic traps forming a bypass gas flow 64. The diverted gas forms an inner chamber gas flow 56 in acoustic trap 46 which gas flow 56 swirls in a continuous circular mixing motion. The continuous change of flow direction of the gas flow 56 and the multiple cycles of mixing break up the sound waves leading to increased random molecular motion of the gas. The key to this process is the circular mixing motion and the retention time of the gas in each acoustic trap.

Figure 10:
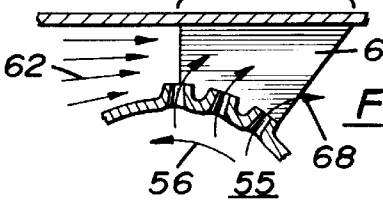
FIG. 10 is a fragmentary enlargement of the portion of FIG. 9 encircled by arrows 10.

The peripheral gas flows 62 are that portion of an inlet gas flow 58 which flows on the back side of acoustic traps 46, away from openings 54. The peripheral gas flows 62 pass through metering screens 50, which are designed to allow a metered amount of gas to pass through so as to optimize the performance of muffler 20. After each peripheral gas flow 62 passes through the respective metering screen 50, it flows along casing side walls 48, where it is accelerated as it passes through narrowed areas between sidewalls 48 and the back side of acoustic traps 46, so as to form a venturi effect downstream thereof, as shown in FIG. 10. Vents 52 are preferably positioned such that they are disposed in a low pressure zone 66 so as to draw gas from inner chamber gas flow 56 from inner chamber 55 through vents 52 to form vent gas flow 68. This drawing of gas through vents 52 helps to make room for more gas flow to enter the inner chamber 55 and to further break up the sound waves. The vent gas flow 68, along with the bypass gas flow 64 add to the volume of peripheral gas flow 62. To compensate for this, the cross-sectional area of successive narrowed areas is larger to accommodate the added gas flow. This venturi action helps empty the gas from inner chamber 55, by accelerating gas flow 56, which is vital in maintaining a high flow rate through muffler 20, and conversely in maintaining a low pressure drop through muffler 20.

It should be noted that the main gas flow 60 is always that gas flow on the side of the traps 46 where entrance openings 54 are located and the peripheral gas flow 62 is always on the back side of traps 46, where vents 52 are located. There may be one main gas flow 60, two, or more, and main gas flow 60 may be in the center of casing 22, or on one or both sides of casing 22. Likewise, peripheral gas flow 62 may be in the center of casing 22, or at the sides thereof, in one, two, or more flows.

Figure 11:
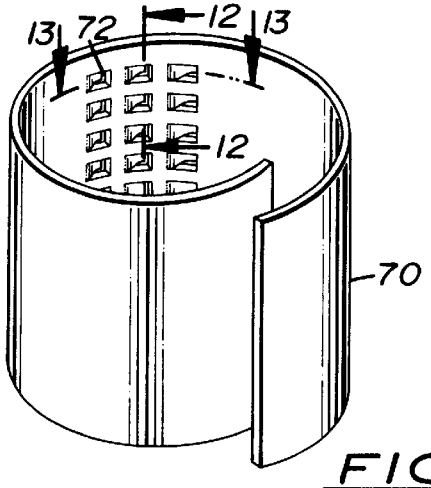
FIG. 11 is a perspective view of a second embodiment of an acoustic trap of the invention.
Figure 12:
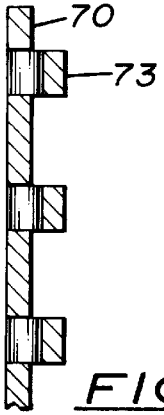
FIG. 12 is a fragmentary longitudinal section taken along the line 12—12 of FIG. 11.
Figure 13:
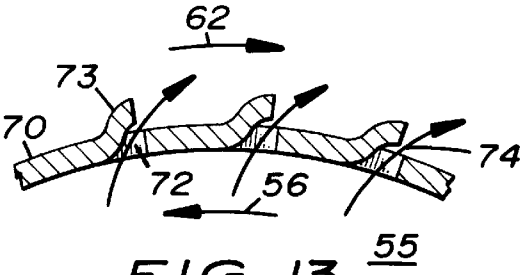
FIG. 13 is a fragmentary transverse section taken along the line 13—13 of FIG. 11.

FIGS. 11, 12, and 13 show an acoustic trap 70 which has a second type of vent 72, which is generally rectangular in shape and formed by outwardly punching, or lancing, three sided rectangular tabs 73, which extend in the direction of the peripheral gas flow 62 outside the acoustic trap. The direction of extension of tabs 73 is important because if they are facing the opposite direction, i.e., forcing the direction of peripheral gas flow, vent gas flow 74 may be imploded or even partially reversed such that some of the peripheral gas flow 62 will enter inner chamber 55, rather than inner chamber gas flow 56 exiting inner chamber 55 as vent gas flow 74 joins the peripheral gas flow 62, resulting in decreased muffler flow with a comparable increase in back pressure.

Figure 14:
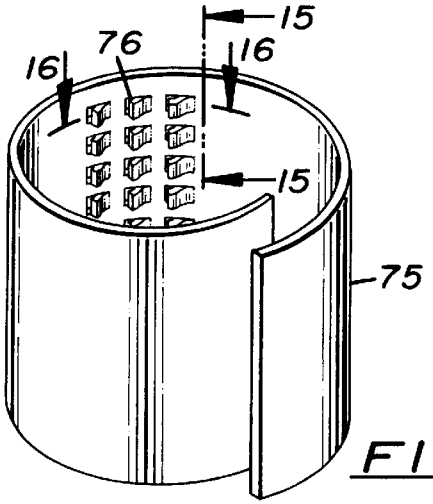
FIG. 14 is a perspective view of a third embodiment of an acoustic trap of the invention.
Figure 15:
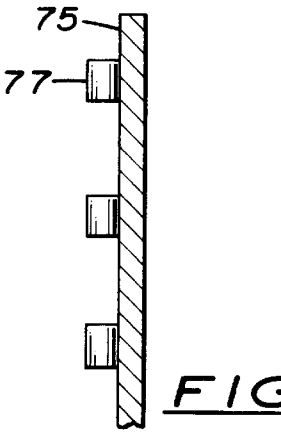
FIG. 15 is a fragmentary longitudinal section taken along the line 15—15 of FIG. 14.
Figure 16:
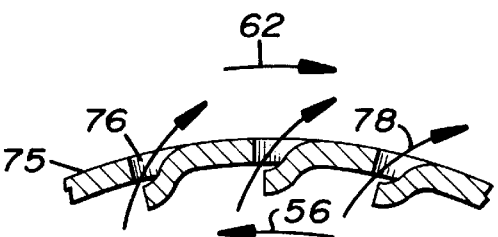
FIG. 16 is a fragmentary transverse section taken along the line 16—16 of FIG. 14.

A third type of vent 76 in an acoustic trap 75 is shown in FIGS. 14, 15, and 16, in which the rectangular vents 76 are formed by punching, or lancing, three sided rectangular tabs 77 inwardly in the direction of the gas flow 56 inside the traps 46. The direction of extension of tabs 77 is important because if the tabs are facing the opposite direction, i.e., facing the direction of inner chamber gas flow 56, vent gas flow 78 will be too high, resulting in less acoustic attenuation.

FIGS. 17, 18, and 19 show an acoustic trap 79 having a fourth type of vent 80 which is round. This embodiment is less efficient than vent 52 (FIGS. 6, 7, and 8) because vents 80 are not dimpled in the direction of vent gas flow 81 so do not smoothly guide the inner chamber gas flow 56 through such vents 80 as vent gas flow 81 with a minimum of turbulence and drag as do vents 52.

FIGS. 20, 21, and 22 show an acoustic trap 82 which has a fifth type of vent 83, formed by punching louvers 84 which extend outwardly in the direction of peripheral gas flow 62, outside the acoustic trap 82. The direction of extension of louvers 84 is important because if they are facing the opposite direction, vent gas flow 85 may be reversed, such that some of the peripheral gas flow 62 will enter inner chamber 55 and gas flow 56, rather than exiting inner chamber 55, resulting in decreased muffler flow and a corresponding increase in back pressure.

FIGS. 23, 24, and 25 show an acoustic trap 86 which has a sixth type of vent 87, formed by punching louvers 88, which extend inwardly in the direction of the gas flow 56 inside the traps. The direction of tab extension is again important because if the tabs are facing the opposite direction, vent gas flow 89 will be too high, resulting in less acoustic attenuation.

Figure 26:
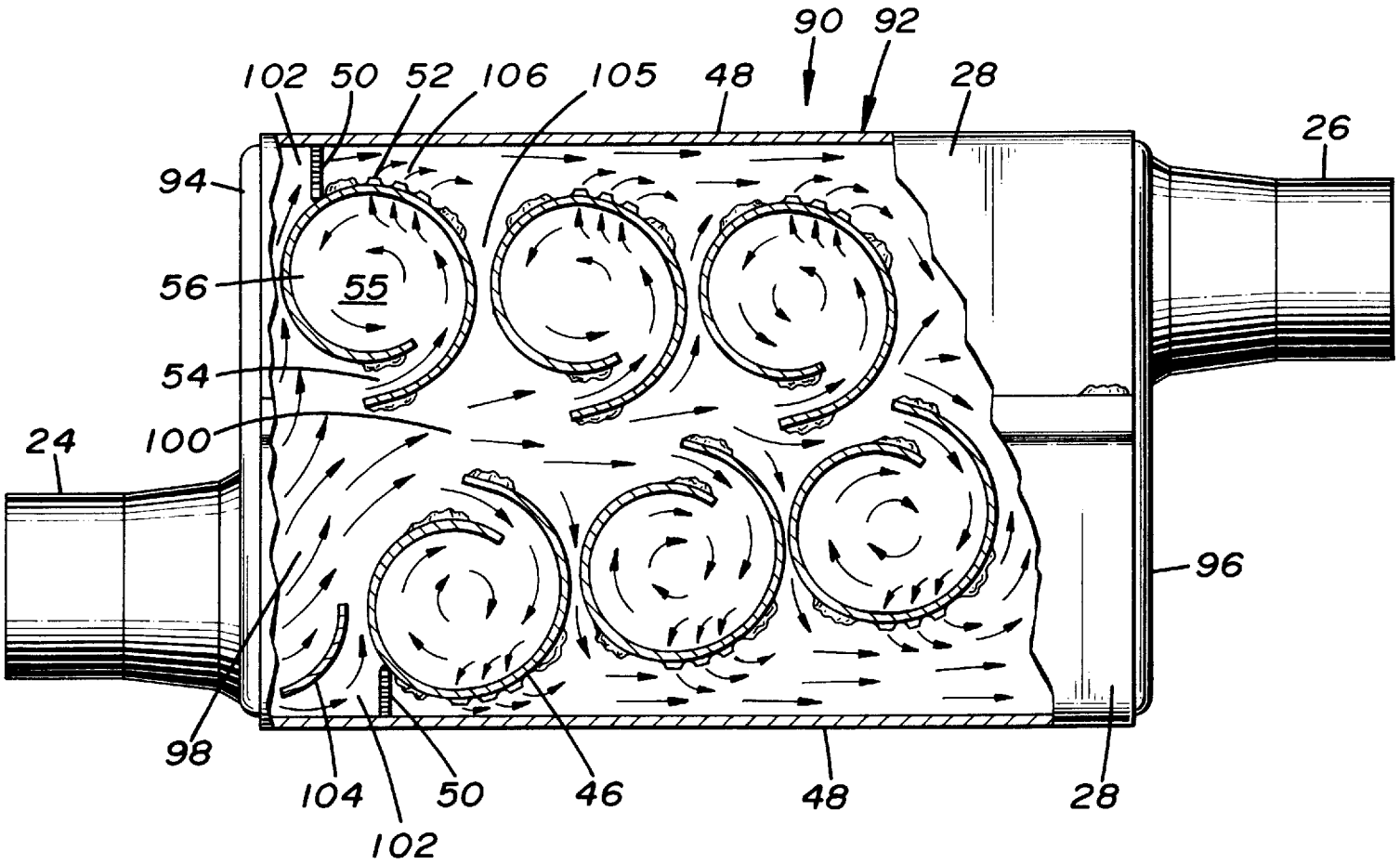
FIG. 26 is a top plan view of a second embodiment of the invention with a portion of the top of the case broken away to show the interior arrangement of the acoustic traps and showing the air flow therein.

Referring to FIG. 26, which shows the air flow of an alternate embodiment muffler 90 which is identical to the embodiment of FIG. 2 except for casing 92 in which inlet tube 24 is offset on inlet cover 94 and outlet tube 26 is offset on outlet cover 96. An inlet gas flow 98 enters through inlet tube 24 where it is broken into a main gas flow 100 and two peripheral gas flows 102 by an arcuate deflector plate 104, which has a central axis substantially perpendicular to the inlet gas flow 98 and which diverts most of inlet gas flow 98 towards the center of muffler 90. Arcuate deflector plate 104 spans between opposing top and bottom walls of casing half 28 and is spaced from casing half side wall 48, acoustic trap 46, and inlet cover 94, so as to allow some gas to circumvent the deflector 104 on both sides thereof. Some of this gas becomes peripheral gas flow 102. A bypass gas flow 105 and a vent gas flow 106 function as in previous embodiments.

FIG. 27 shows another alternate embodiment muffler 108 which is narrower than previous embodiments and utilizes only a single group of acoustic traps 46. Muffler 108 is designed for lower flow rate applications and therefore has a narrower casing 110, which is constructed like previous embodiments from a pair of U-shaped casings halves 112. Muffler 108 comprises an inlet cover 114, inlet tube 24, an outlet cover 116, and outlet tube 26 which are welded with casing halves 112 and acoustic traps 46. This embodiment has an inlet gas flow 118, a main gas flow 120 which flows adjacent a casing side wall 122, and only one peripheral gas flow 124, which flows adjacent the other casing side wall 122. A space 124 between the last acoustic trap 46 of the group and casing wall 122 allows some of the main gas flow 120 to bypass the last of openings 54 so as to maintain a smooth gas flow. A bypass gas flow 126 and a vent gas flow 128 function as in previous embodiments.

It should be noted that in the embodiment of FIG. 27, as well as in all other embodiments of the invention, that an arcuate metering plate may be used in conjunction with or as a replacement for each metering screen. The metering plate is a dual-function component which replaces a metering screen, which has a central axis perpendicular to the inlet gas flow 118, which spans between opposing walls of casing half walls 112, and which is typically closely spaced from an acoustic trap and from the casing side walls, closer than an arcuate deflector plate, so as to deflect part of the inlet gas flow and yet permit a metered portion of the inlet gas flow to move past the metering plate so as to form the peripheral gas flow. An arcuate deflector plate may, in some cases replace a metering screen, the deflector plate being spaced further from an acoustic trap and a casing sidewall than the arcuate deflector plate. The arcuate deflector plate and/or the metering plate may have one or more perforations therethrough. Whether a metering screen and/or an arcuate deflector plate, or a metering plate is utilized depends on the particular acoustic characteristics necessary for a particular muffler application. For example, in FIG. 27, a configuration is utilized wherein the metering screen is replaced by a metering plate 123, which plate is closely spaced from acoustic trap 46 and casing sidewall 122. Further, in some cases, the spacing between the acoustic traps and the muffler walls will be sufficient to meter the peripheral gas flow without the need for a metering screen or metering plate.

Figure 28:
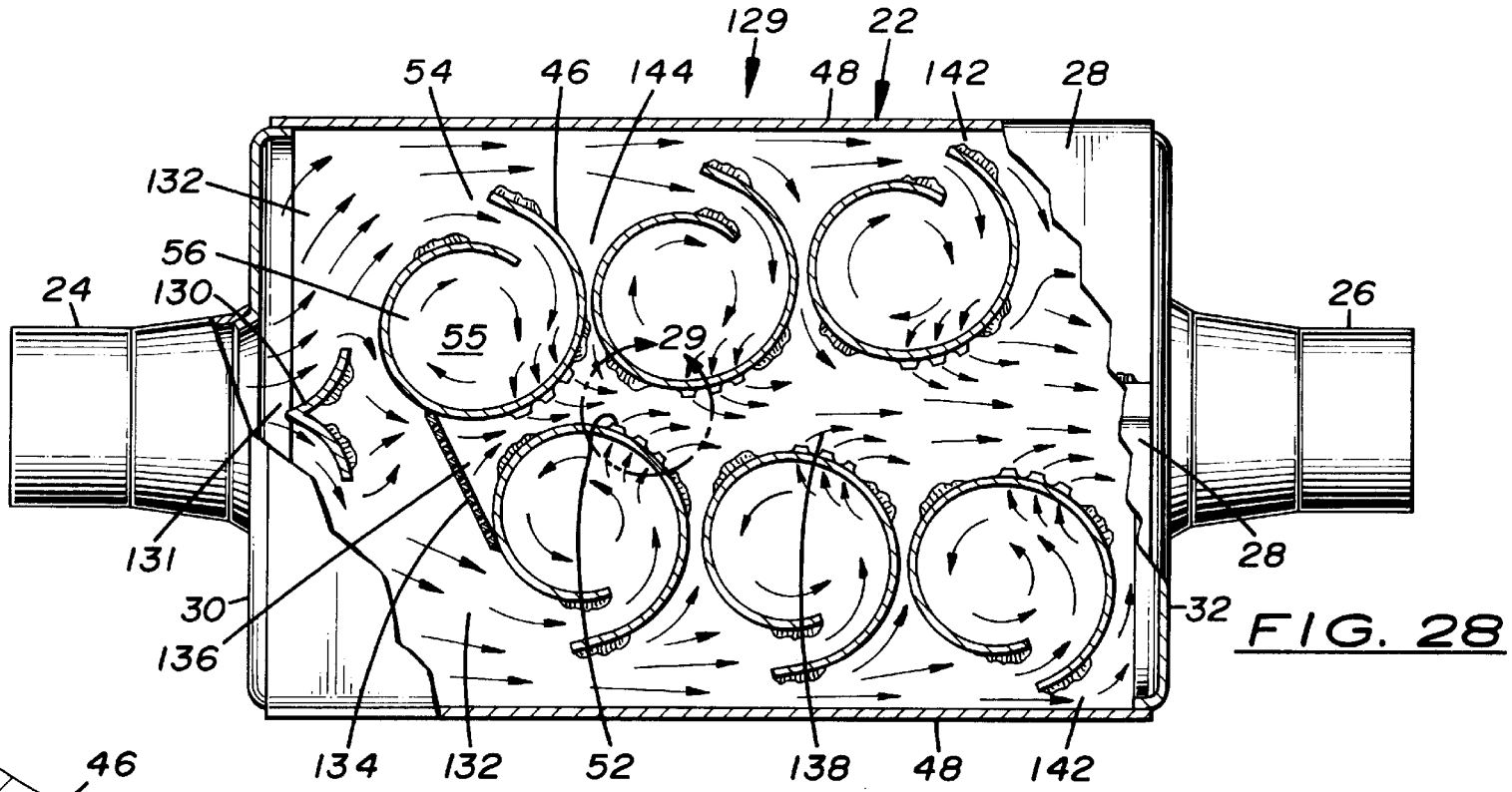
FIG. 28 is a top plan view of a fourth embodiment of the invention with a portion of the top of the case broken away to show the interior arrangement of the acoustic traps and showing the air flow therein.
Figure 29:
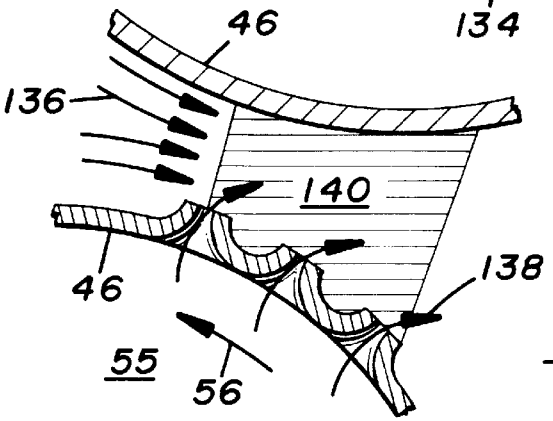
FIG. 29 is a fragmentary enlargement of the portion of FIG. 28 encircled by arrows 29.

Referring to FIG. 28, an alternate embodiment muffler 129 is shown, which is similar to that in FIG. 2, such as by utilizing the same casing 22 and acoustic traps 46. The differences are that the groups of acoustic traps 46 are reversed in position, laterally, and positioned in a diverging relationship, rather than in a converging relationship. An arcuate v-shaped inlet deflector 130, is used to split an inlet gas flow 131 into two main gas flows 132, part of which passes around inlet deflector 130 and through an elongated metering screen 134, to form an internal peripheral flow 136. While deflector 130 is shown as an arcuate V-shape, it could also be a flat V-shape. Peripheral gas flow 136 travels down the longitudinal center of casing 22, wherein the same type of venturi effect occurs as in previous embodiments, so as to draw vent gas flow 138 into a reduced pressure zone 140 (FIG. 29). The main gas flows 132 travel along side walls 48 and are incrementally scooped into acoustic traps 46 until only a small portion of the main flow 132 remains, which portion passes between the last of traps 46 and side walls 48 through an opening 142. As before, some bypass gas 144 bypasses the traps 46 and joins the peripheral gas flow 136, and the vent gas flow 138 also joins peripheral gas flow 136 after being drawn from traps 46.

Figure 30:
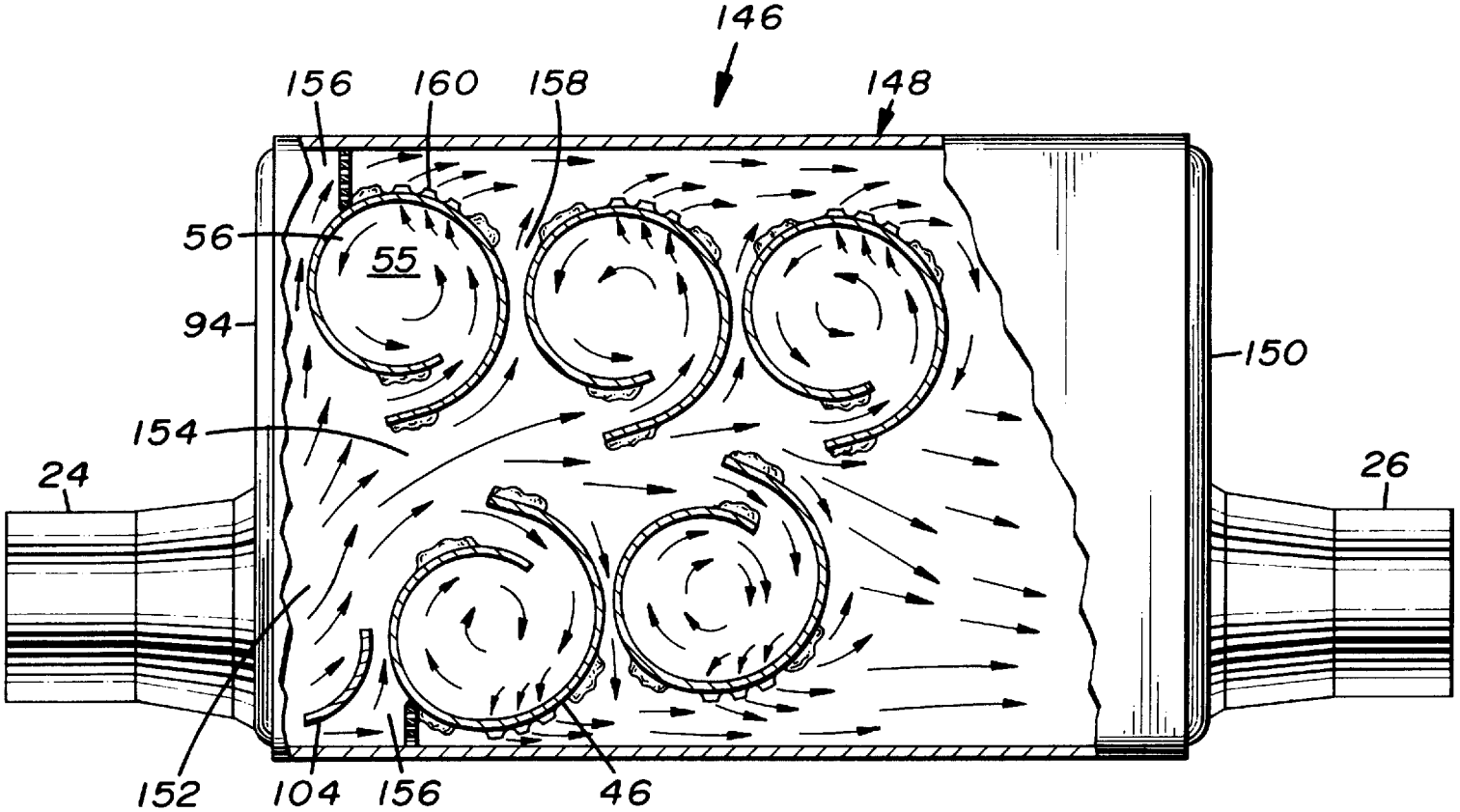
FIG. 30 is a top plan view of a fifth embodiment of the invention with a portion of the top of the case broken away to show the interior arrangement of the acoustic traps and showing the air flow.

FIG. 30 shows an alternate embodiment muffler 146, which is the same as that shown in FIG. 26, except for having one less acoustic trap 46, and a different casing 148, in which outlet tube 26 is located on an outlet cover 150, so as to be in line with inlet tube 24. The gas flow is similar between this embodiment and that of FIG. 26. An inlet gas flow 152 enters through inlet tube 24, most of which is diverted by arcuate deflector plate 104 towards the center of muffler 146 and which is broken into a main gas flow 154 and two peripheral gas flows 156. A bypass gas flow 158 and a vent gas flow 160 function as in previous embodiments.

As indicated, the important feature of the muffler is that a main gas flow is established across the entrance openings of a plurality of acoustic traps so that a substantial portion of the main gas flow is directed into the traps. Trap outlets allow gas directed into the traps to exit the traps after flow into the traps so that gas flow through the traps is established. Various flow arrangements through the traps and through the mufflers may be used. While it is preferable that a venturi effect be created around the back side of the traps and that the trap outlets open into the area of low pressure created by this venturi effect since this promotes gas flow through the traps, the trap outlets may be differently positioned.

In summary, the acoustic muffler of the invention provides reduced back pressure or conversely higher gas flow rates for a given acoustic attenuation resulting in higher acoustic efficiency. As stated previously, muffler acoustic efficiency is measured in decibels of noise attenuation (dba) versus gas flow rate in cubic feet per minute (CFM). As indicated, with a pressure difference of five inches of water across the muffler and standard 2½ inch diameter muffler inlet and outlet, a friction muffler has about 13–20 dba attenuation and about 70–100 CFM flow. Absorption type mufflers have about 2–7 dba attenuation and about 200 or more CFM gas flow. The muffler of the invention has about 8–15 dba with about 175 CFM gas flow.

While the embodiments of the muffler shown in the drawings have from four to six spiral acoustic traps, any number of traps from one to six or more may be used. The use of one acoustic trap provides some acoustic attenuation with three to six acoustic traps providing the best acoustic attenuation. More than six acoustic traps may be used, however, but with limited additional acoustic attenuation benefit.

The embodiments of the muffler show the gas flowing generally from an inlet at one end of the casing to an outlet at the opposite end thereof. However, various other arrangements of inlet and outlet are possible including inlet and outlet being on the same side of the casing.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A muffler for attenuating acoustic noise in a gas flow, comprising:

a casing;

an inlet in said casing;

an outlet in said casing, whereby gas flows in said casing from said inlet to said outlet;

a plurality of spiral acoustic traps formed by spiral trap walls disposed in said casing, spanning between a pair of opposing top and bottom walls of said casing, and having a central axis substantially perpendicular to the general direction of said gas flow, each spiral having an entrance opening into said gas flow and a back side substantially opposite said entrance, with that of said gas flow which flows across said entrance comprising a main gas flow, and the remaining gas flow which passes on the back side comprising a peripheral gas flow; and a plurality of vents through said trap wall of each of said acoustic traps, said vents positioned on the back side of said trap such that said peripheral gas flow forms a low pressure zone at said vents, due to a venturi effect created by said peripheral gas flow passing through a narrowed area between said outside of said trap and an adjacent wall, so as to draw gas from the inside of said trap through said vents.

2. The acoustic muffler of claim 1, wherein:

said acoustic traps extend in a single linear group spaced from opposing side walls of said casing, with said openings converging toward one of said opposing side walls;

flow regulating means adapted to regulate the peripheral gas flow; and said adjacent wall is said other side wall of said casing.

3. The acoustic muffler of claim 2, wherein said vents are round.

4. The acoustic muffler of claim 3, wherein said wall around each of said vents is pushed outward from said central axis so as to form a dimple.

5. The muffler of claim 2, wherein said vents are generally rectangular in shape and formed by outwardly punching three sided rectangular tabs which extend in the direction of the peripheral gas flow outside said trap.

6. The muffler of claim 2, wherein said vents are generally rectangular in shape and formed by inwardly punching three sided rectangular tabs which extend in the direction of the gas flow inside said traps.

7. The muffler of claim 2, wherein said vents are outwardly extending louvers which extend in the direction of the peripheral gas flow outside the acoustic trap.

8. The muffler of claim 2, wherein said vents are inwardly extending louvers which extend in the direction of the gas flow inside the acoustic traps.

9. The acoustic muffler of claim 1, wherein:

said acoustic traps extend in two converging linear groups spaced from said side walls;

a flow regulating means adapted to regulate the peripheral gas flow; and said inlet and said outlet are coaxially disposed about the longitudinal centerline of said casing; and said adjacent wall is said side wall of said casing.

10. The acoustic muffler of claim 9, wherein said vents are round.

11. The acoustic muffler of claim 9, wherein said wall around each of said vents is pushed outward from said central axis to form a dimple.

12. The muffler of claim 9, wherein said vents are generally rectangular in shape and formed by outwardly punching three sided rectangular tabs which extend in the direction of the peripheral gas flow outside said trap.

13. The muffler of claim 9, wherein said vents are generally rectangular in shape and formed by inwardly punching three sided rectangular tabs which extend in the direction of the gas flow inside said traps.

14. The muffler of claim 9, wherein said vents are outwardly extending louvers which extend in the direction of the peripheral gas flow outside the acoustic trap.

15. The muffler of claim 9, wherein said vents are inwardly extending louvers which extend in the direction of the gas flow inside the acoustic traps.

16. The acoustic muffler of claim 1, wherein:

said acoustic traps extend in two converging linear groups spaced from said side walls;

a flow regulating means adapted to regulate the peripheral gas flow; and said inlet and said outlet are offset axially, adjacent said side walls;

said muffler includes an arcuate deflector plate to direct inlet gas from said inlet toward the center of said casing said adjacent wall is said wall of said casing.

17. The acoustic muffler of claim 16, wherein said vents are round.

18. The acoustic muffler of claim 16, wherein said wall around each of said vents is pushed outward from said central axis to form a dimple.

19. The muffler of claim 16, wherein said vents are generally rectangular in shape and formed by outwardly punching three sided rectangular tabs which extend in the direction of the peripheral gas flow outside said trap.

20. The muffler of claim 16, wherein said vents are generally rectangular in shape and formed by inwardly punching three sided rectangular tabs which extend in the direction of the gas flow inside said traps.

21. The muffler of claim 16, wherein said vents are outwardly extending louvers which extend in the direction of the peripheral gas flow outside the acoustic trap.

22. The muffler of claim 16, wherein said vents are inwardly extending louvers which extend in the direction of the gas flow inside the acoustic traps.

23. The acoustic muffler of claim 1, wherein:

said acoustic traps extend in two diverging linear groups spaced from said side walls;

a v-shaped inlet deflector separates the inlet gas flow entering said casing into two main flows, with one along each of said sidewalls, and a peripheral flow between the groups of said acoustic traps;

said inlet and said outlet are coaxially disposed about the longitudinal centerline of said casing; and said adjacent wall is said wall of said adjacent acoustic trap.

24. The acoustic muffler of claim 23, wherein said vents are round.

25. The acoustic muffler of claim 23, wherein said wall around each of said vents is pushed outward from said central axis to form a dimple.

26. The muffler of claim 23, wherein said vents are generally rectangular in shape and formed by outwardly punching three sided rectangular tabs which extend in the direction of the peripheral gas flow outside said trap.

27. The muffler of claim 23, wherein said vents are generally rectangular in shape and formed by inwardly punching three sided rectangular tabs which extend in the direction of the gas flow inside said traps.

28. The muffler of claim 23, wherein said vents are outwardly extending louvers which extend in the direction of the peripheral gas flow outside the acoustic trap.

29. The muffler of claim 23, wherein said vents are inwardly extending louvers which extend in the direction of the gas flow inside the acoustic traps.

30. A muffler for attenuating acoustic noise in a gas flow, comprising:

a casing;

an inlet to the casing;

an outlet from the casing, whereby gas flows through the casing from inlet to said outlet; and at least one spiral acoustic trap disposed in said casing, said trap having an entrance opening and at least one vent outlet, the trap being positioned in the casing so that a portion of the gas flowing through the casing will flow through said spiral acoustic trap and at least a portion of the remaining gas flow forming a low pressure zone outside the vent outlet to draw gas from the inside of said trap through said vent outlet.

31. A method of attenuating acoustic noise in a gas flow, comprising the steps of;

providing a gas flow containing acoustic noise;

splitting off a main portion of said gas flow into a spiral acoustic trap, with the remaining portion, comprising a peripheral gas flow, flowing outside of said trap;

circularly mixing the main gas flow in said trap;

forming a low pressure zone outside of said trap by directing said peripheral gas flow through a venturi created outside of said trap so as to continually draw a portion of said main gas flow through a plurality of vents in said trap.

32. The method for attenuating acoustic noise in a gas flow of claim 31, further comprising the step of controlling the peripheral gas flow.

* * * * *